United States Patent [19]

Chuard

[11] 4,220,018

[45] Sep. 2, 1980

[54] DISPLAY DEVICE FOR ORNAMENTAL OBJECTS

[76] Inventor: Edmond H. Chuard, 35, rue de l'Athénée, Geneva, Switzerland, 1206

[21] Appl. No.: 811,035

[22] Filed: Jun. 29, 1977

[30] Foreign Application Priority Data

May 11, 1976 [CH] Switzerland ..... 13937/76

[51] Int. Cl.[2] ..... A44C 17/02

[52] U.S. Cl. ..... 63/29 R; 63/31; 428/28

[58] Field of Search ..... 63/1, 2, 29, 32, 31, 63/23; 428/7, 11, 13, 14, 28; 362/376

[56] References Cited

U.S. PATENT DOCUMENTS

| | | | |
|---|---|---|---|
| 243,021 | 6/1881 | Welin | 428/28 |
| 1,781,687 | 11/1930 | Hazman | 428/28 |
| 3,129,569 | 4/1964 | Ballantyne | 63/29 R |
| 3,377,230 | 4/1968 | Hutley | 428/28 |
| 3,549,465 | 12/1970 | Skelley | 428/11 |

FOREIGN PATENT DOCUMENTS

| | | | |
|---|---|---|---|
| 929319 | 7/1947 | France | 63/31 |
| 1282154 | 12/1961 | France | 63/2 |
| 1496191 | 8/1967 | France | 63/2 |
| 11416 | of 1910 | United Kingdom | 63/23 |

*Primary Examiner*—F. Barry Shay
*Attorney, Agent, or Firm*—Weinstein & Sutton

[57] ABSTRACT

An ornamental display device having a mounting device and, attached thereto, a cage-like structure for holding and presenting an ornamental object like a gem. The cage-like structure is formed by at least three filaments and has a normally closed and an open position. The ornamental object can be removed and interchanged when the cage is in its open position.

11 Claims, 8 Drawing Figures

DISPLAY DEVICE FOR ORNAMENTAL OBJECTS

BACKGROUND AND SUMMARY OF THE INVENTION

This invention relates to new and useful improvements in ornamental articles, such as jewelry, and more particularly pertains to a display device suitable for removably holding ornamental objects like stones and other pleasant or valuable objects, and pieces of personal adornment.

At the present time, numerous forms of jewelry and ornamental articles are known wherein one or more ornamental objects like stones are held by mounting devices. All these ornamenting articles have the common character that the ornamental objects are fixed in a solid, captive and nonremovable manner to a mounting device, an armature or another equivalent means, permitting the wearing and display of said ornamental objects. For example, it is well known that in pendants, a pearl or a gem is fixed by a rivet which traverses a bore in the pearl or gem, to a metallic mounting piece which is supported by a chain to be worn around the neck of the wearer.

Another solution of fixing pearls or gems to a metallic mounting has become known. In this solution, special ornaments like beads and pearls having diametrical bores are supported by rods which extend through these bores, and a number of such rods form the mounting device, see U.S. Pat. No. 1,781,687 (Jacob Hazman). Here again, there is no possibility to conveniently remove the beads or pearls.

In French Pat. No. 929,319 (Marc Koven), rings and pendants are disclosed wherein one or more precious stones are confined within a rigid cage. The cage is formed by strong metallic wires or rods. In the case of a pendant, the cage may have the form of a spiral. But in all these embodiments, a removable holding of ornamental pieces is not foreseen nor suggested.

For some years, a new kind of ornament has been widely distributed on the market, namely fashion or popular adornments, having a relatively low price even for young women who do not have much money. The relatively low price of these ornaments allows the wearer to use more than one ornament a day or an evening, and to adapt them easily to the costumes and the particular occasions.

With the foregoing in mind it is now to be noted that the present invention has for its primary objective to provide an ornament display device of today's fashion which permits the wearer to change the ornamental effect of the display device without changing the display device itself.

Another objective of the invention is to provide a display device wherein an ornamental object may easily be removed and replaced by another one.

A further objective of the invention is to provide a display device article of the kind defined above wherein the removable ornamental object or piece is firmly confined within an enclosure during its use but perfectly visible therein.

Another objective of the invention is to provide a display device of the kind described above where the structure holding the ornamental object is as little visible as possible.

A still further objective of this invention is to provide a display device complying with all aesthetic requirements and avoiding the disadvantageous aspect of an inexpensive fashion adornment, thereby giving the appearance of presenting as a piece of jewelry of good or outstanding quality.

Now in order to implement these and still further objects of the invention which will become more readily apparent as the description proceeds, the invention involves a display device comprising a mounting device and a cage-like structure adjacent the mounting device for visibly holding therein an ornamental object. The cage-like structure, which is formed by a plurality of filaments has a closed position and an open position. In its closed position, the cage-like structure is arranged for holding the ornamental object within the space formed by the filaments and the mounting device, the ornamental object being removable and interchangeable when the cage-like structure is in its open position.

BRIEF DESCRIPTION OF THE DRAWING

The invention will be better understood and additional objects and features thereof will become more apparent from the following description of embodiments and the accompanying drawing wherein like numerals of reference indicate like parts and wherein.

DETAILED DESCRIPTION OF THE PREFERRED EMBODIMENTS

Before dealing specifically with preferred embodiments of the present invention, some general features and facets thereof should be described.

The display device of the invention is preferably a pendant but may also be a key-ring, amulet, jewel of any kind, bracelet hanger, etc. The filaments which form the cage and which serve to enclose and retain one or more ornamental objects are generally as thin as possible in order to not hide the object. Elastic filaments are highly preferred; they are generally made of steel. If no or not a high elasticity is requested, the filaments may also be of synthetic materials like nylon, polyolefine, polyester etc.

The filaments may have an ornamental aspect. In this case, they may be made of a noble metal or a non-corrosive ordinary metal. Examples for such metals are silver, gold, platinum, iridium and their alloys, nickel, brass and stainless steel. Steel filaments may be plated with a noble or non-corrosive metal. The surface of such filaments or wires can be decorated or engraved, and the wires may also be twisted. Furthermore, it is possible to fit them with ornamental elements, such as little precious or semiprecious stones or pearls.

Three filaments are sufficient to form the cage. However, in order to minimize the risk of losing the ornamental object, more than three filaments are preferred, e.g. four, five, six or eight filaments or wires.

The ornamental object must be held firmly, but in a removable and interchangeable manner within the cage. Embodiments are provided wherein the cage formed by the filaments can completely be separated from the mounting device. In other embodiments, at least one of the filaments is fixed to the mounting device, and only part of the filaments is removably connected to the mounting device or to other filaments so that the ornamental object may be interchanged.

The ornamental object may be selected by the wearer of the article. Examples of ornamental objects capable of being inserted into the cage are precious stones like rubies, sapphires, emeralds; semiprecious stones like agate, turmaline, amethyst, rock crystal etc., these stones being polished or unpolished; furthermore shells, pebbles, fruits, nuts, pearls, medallions, watches, flowers, snail-shells, lockets, etc. A preferred embodiment provides a mounting device with three removable cages of different sizes so that the latter can be adapted to the object to be enclosed.

The cage and the mounting device may be adapted for mutual rotative motion in order to best present the most pleasant face of the object in the cage.

Figure 1:
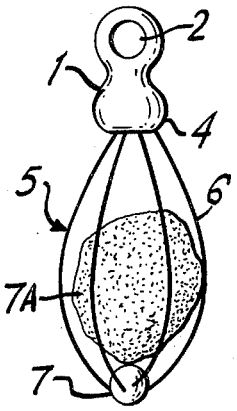
FIG. 1 is a side elevational view of a first embodiment having the form of a pendant.
Figure 2:
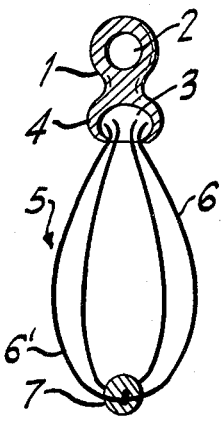
FIG. 2 is a longitudinal section of the pendant of FIG. 1, the gem inside the cage being omitted.
Figure 3:
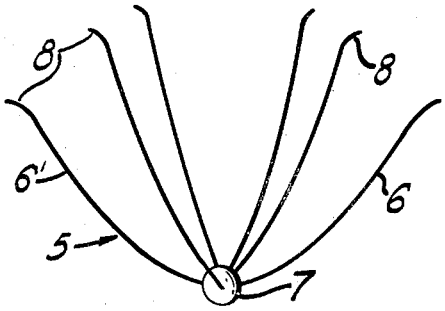
FIG. 3 represents a side view of the cage after its separation from the mounting of FIG. 1.

Referring now to FIGS. 1 and 2 of the drawing, the ornamental article has a mounting device 1 and a cage-like structure 5.

The mounting device 1 is a bulb-like piece of metal or plastic material having an opening 2 wherein a chain may be provided. At its lower end (see FIG. 2), the mounting device 1, which may include ornamental elements, is hollow so as to form a cavity 3 which has a generally circular cross-sectional shape and an edge 4. The cage is formed by six steel wires 6,6'. One end of these wires is fixed in a bead 7 so that diametrical opposed wires 6,6' are in reality one wire having the bead 7 at its mid portion (see FIG. 2). The free end of all wires 6,6' is bent outwardly to form a hook 8, and all hooks are received in the cavity 3. In FIG. 1, an ornamental object 7A, e.g. a pyrite crystal, is shown enclosed in the cage.

It is to be noted that the cage may be rotated relative to the mounting device 1 since the hooks 8 may slide in the cavity 3. However, two, three or four wires may be fixed in the cavity 3, as by soldering, and the cage can still be opened by unhooking the free wires.

Figure 6:
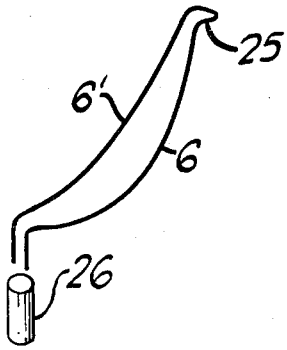
FIG. 6 is a variant of the embodiments shown in FIGS. 1 to 4.

It is furthermore possible (see FIG. 6) and even preferred to join adjacent wires 6,6' pair-wise (this means to make them from a wire of double length) and to form a hook 25 common to both wires. Therefore, only three wire pairs need be inserted into the cavity 3, and the hook has no sharp or pointed end which presents certain advantages: the closing operation is less troublesome and more rapid. The two wires 6,6' of FIG. 6 are made from one length of wire, and the free ends of the all wires may be inserted into a little tube 26 wherein they are fixed. The final cage has therefore the aspect of a flower having two, three, four or more petals.

The wires or filaments may be soldered to the bead 7 or the tube 26, which are then of metal, or they may be fixed thereto by pressing. The bead 7 may also be an ornamenting piece when it receives an appropriate shape and work or ornamental element. It need not be spherical. For example, it may be oval, polyhedric, or any other shape.

Figure 4:
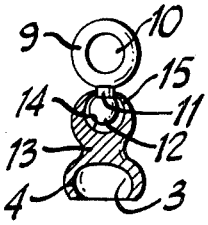
FIG. 4 is a longitudinal section analogous to that of FIG. 2, of the mounting of another embodiment, at a greater scale.

A rotation of the cage relative to the mounting may be accomplished in another manner, see FIG. 4. The upper portion of the mounting 9, comprising an opening 10, is provided with a stem 11 which ends in a head 12. The lower part 13 has an internal groove 14 wherein the head 12 may rotate, and a collar 15 which surrounds the stem 11. In this way, part 13 may freely rotate about part 9.

In the described embodiments, the wires 6 terminate in hooks 8. However, in a further embodiment, the wires may have straight ends terminating in small balls which may be engaged into the circular groove of the cavity 3, and the wires are maintained therein by their inherent elasticity. The balls may also be engaged by appropriate circular recesses in the wall of the cavity 3.

Figure 7:
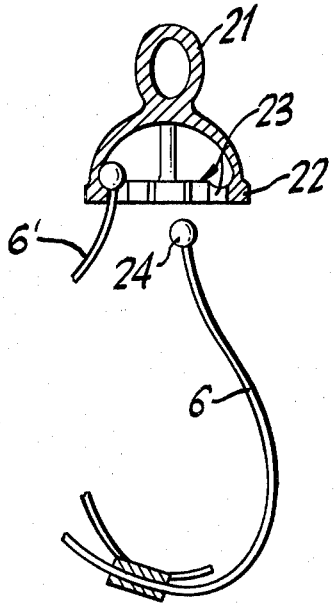
FIG. 7 is a sectional side view of a fourth embodiment of the invention.

The display device may, in such cases, also present the form represented in FIG. 7. The mounting is generally ring-shaped and has a first ring 21, generally of metal, which is fixed to a second ring 22 the inner periphery or wall of which is provided with slots 23 wherein the wires 6 may be inserted. Due to the elasticity of the wires 6 of the cage, the wires are maintained in their respective slots, and the balls 24 hinder them from sliding out of the ring 22. The balls 24 serve at the same time as additional decorative elements.

Figure 5:
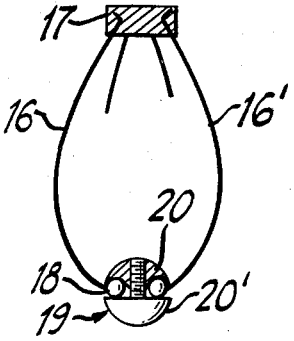
FIG. 5 is a longitudinal section of a third embodiment, the cage being opened and closed at its lower end.

The cage may have its closure at the bottom instead at the top, as described above, see FIG. 5. In this embodiment, the wires or filaments 16, 16' are pressed with one of their ends in the block 17 which forms part, in a fixed or rotative manner, of the mounting device. The wires 16, 16' terminate at their free ends by balls 18 which are received in a corresponding circular, toroid shaped groove of the closure 19. This closure is constituted of two half-shells 20 and 20', linked by a screw, a threaded shaft or a tension spring to join them together but to allow at least a partial separation to liberate the balls 18 whereby the cage can be opened. This opening will be a partial one if some of the balls are thicker than the remainder, as it can easily be understood.

In all of the described embodiments, the closed position of the cage may be locked. Locking means are generally known to the one skilled in the art. For example, in the embodiment shown in FIGS. 1 to 4, a conical piece may be screwed from below into the cavity 3 when the mounting device 1 is rotated relative to the cage.

Figure 8:
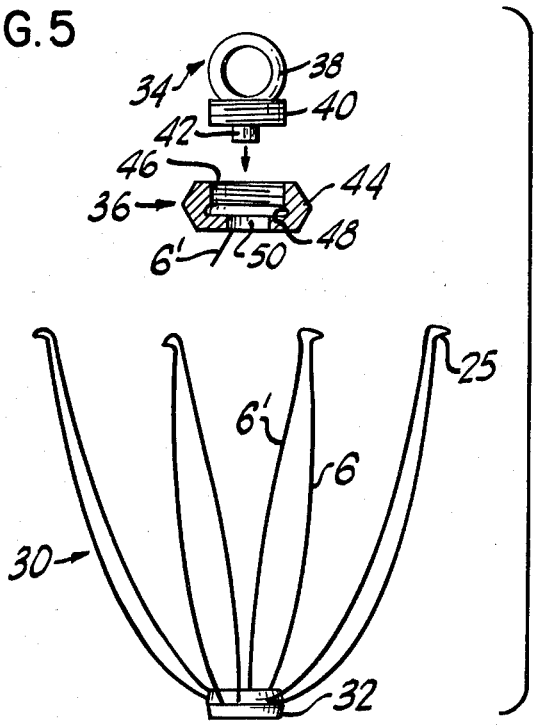
FIG. 8 is a longitudinal section of a fifth embodiment, the cage being shown perspectively in its open position.

A preferred embodiment with locked closure is shown in an exploded sectional view in FIG. 8. The cage, generally designed by 30, has four pairs of gold plated steel wires 6, 6' provided with hooks 25, see also FIG. 6. A flat block 32 holds the wires together at the bottom of the cage 30.

The mounting device comprises an upper part 34 and a lower part 36. The chain ring 38 of the upper part 34 is fixed to a threaded cylindrical portion 40 which bears, on its lower flat surface, a cylindrical bolt 42.

The lower part 36 is formed by a hollow ring 44 having an inner thread 46 fitting to the thread 40. The circular recess 48 facilitates the insertion of the hooks 25 which are represented in dotted lines. The diameter of the lower opening 50 is such that the bolt 42 may penetrate in the opening 50 when all wires 6, 6' have their hooks 25 inserted into the part 36. When the upper part 34 is screwed into the lower part 36, the bolt 42 closes the opening 50 and, simultaneously, the hooks engage the lower flat surface of the cylinder 40. It is now impossible to disengage the cage from the mounting device.

It is to be understood that the form of the invention herein shown and described is to be taken as preferred examples of the same and that various changes in the shape, size and arrangement of parts may be resorted to without departing from the spirit of the invention or the scope of the following claims.

What is claimed is:

1. A display device for an ornament, comprising a pair of relatively elastic filament elements, each of said filament elements having a generally U-shaped hook formed between the free ends thereof; connecting means for holding said free ends of said filament elements; and mounting means for holding said U-shaped hooks of said filament elements, said filament elements, connecting means, and mounting means cooperating to form cage means for receiving and supporting an ornament in a freely movable manner therein, said filament elements being of a size such that an ornament disposed within said cage means is visibly displayed, and at least one of said U-shaped hooks being releasably attached to said mounting means to permit the selective interchange of ornaments.

2. A display device according to claim 1, wherein said mounting means includes an upper member and a lower member, said upper member including a generally cylindrical externally threaded body, a chain ring attached to one end of said body, and a generally cylindrical stud attached to the other end of said body, said lower member including an internally threaded portion for threadedly engaging said externally threaded body of said upper member and an aperture for receiving said stud and said U-shaped hooks.

3. A display device according to claim 2, wherein said filament elements are rotatable relative to said mounting means about a longitudinal axis of said aperture.

4. A display device according to claim 1, wherein said filament elements are rotatable relative to said mounting means.

5. A display device according to claim 1, wherein said filament elements are shaped so as to have an ornamental appearance.

6. A display device according to claim 1, wherein said connecting means has an ornamental shape.

7. A display device according to claim 1, wherein each of said filament elements includes an ornamental element.

8. A display device according to claim 1, wherein said mounting means includes an ornamental element.

9. A display device according to claim 1, wherein said connecting means includes an ornamental element.

10. A display device according to claim 1, wherein said display device is in the form of a pendant.

11. A display device according to claim 1, further comprising at least one other filament element having a U-shaped hook between the free ends thereof which are attached to said connecting means, said U-shaped hook being held by said mounting means.

* * * * *